US006189237B1

(12) United States Patent
Mayer et al.

(10) Patent No.: US 6,189,237 B1
(45) Date of Patent: Feb. 20, 2001

(54) PROCESS FOR DRYING A WEB

(75) Inventors: Roland Mayer, Heidenheim; Karl Steiner, Herbrechtingen, both of (DE)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/274,880

(22) Filed: Mar. 23, 1999

(30) Foreign Application Priority Data

Mar. 24, 1998 (DE) ..... 198 13 111

(51) Int. Cl.[7] ..... F26B 3/00

(52) U.S. Cl. ..... 34/452; 34/460; 34/463; 34/507

(58) Field of Search ..... 34/425, 448, 452, 34/460, 463, 465, 111, 114, 116, 117, 120, 122, 123, 507

(56) References Cited

U.S. PATENT DOCUMENTS 3,303,576 * 2/1967 Sisson ..... 34/115
3,879,858 * 4/1975 Candor et al. ..... 34/452

FOREIGN PATENT DOCUMENTS 1830413 1/1961 (DE) .
1629008 11/1976 (DE) .

* cited by examiner

*Primary Examiner*—Pamela Wilson
(74) *Attorney, Agent, or Firm*—Greenblum & Bernstein, P.L.C.

(57) ABSTRACT

Process and device for drying a moving web. The process includes vaporizing moisture in the web, creating a blanket of compressed air along a first surface of the web, and the blanket of compressed air directing the vaporized moisture in a direction from the first surface toward a second surface of the web that faces away from said blanket of compressed air. The device includes an air-tight guide element positioned adjacent to the moving web and positioned to create a blanket of compressed air between the moving web and the air-tight guide element

20 Claims, 1 Drawing Sheet

PROCESS FOR DRYING A WEB

CROSS-REFERENCE TO RELATED APPLICATIONS

The present application claims priority under 35 U.S.C.§ 119 of German Patent Application No. 198 13 111.9, filed on Mar. 24, 1998, the disclosure of which is expressly incorporated by reference herein in its entirety.

BACKGROUND OF THE INVENTION

1. Field of the Invention

The present invention relates to a procedure and device for drying a web, e.g., a paper or tissue web, in motion in a machine for producing or converting the web.

2. Discussion of Background Information

Guiding the web over rotating, heated cylinders for drying is known in the art. Heating the web in this manner releases moisture in the form of steam. As the dry content of the web increases, however, the capacity of the web to outwardly release steam from the inside decreases.

This evaporation can be intensified by guiding the web over vacuum guide rolls. Generally such guide rolls are composed of a perforated roll sleeve having a negative pressure created inside either directly, through connection with a negative pressure source, or indirectly, through suctioning or vacuuming of an area of the perforated roll sleeve that is not covered by the web.

In this manner, the negative pressure draws the steam out of the web. However, creating the requisite negative pressure, particularly at a high level, is associated with significant technical expense and expenditure of energy.

SUMMARY OF THE INVENTION

The present invention, therefore, provides a process and device for drying a web in a manner that improves the carrying off of steam from the web relatively simply.

According to the present invention, a blanket of compressed air is created on one side of the web that presses the steam of the web toward a side of the web facing away from the created blanket of compressed air. The blanket of compressed air may be created between the web and an air-tight guide element so that a boundary layer of air carried along with the web, i.e., entrained air, is accumulated via a damming effect by the guide element. The pressure in the blanket of compressed air can attain a value of, e.g., between approximately 0.01 and 0.2 bar.

This manner of creating compressed air, while relatively simple, may be very effective with regard to transporting steam. The process can be further supported in that the side of the web facing away from the blanket of compressed air may be subjected to a vacuum. In this manner, a relatively low degree of negative pressure can be sufficient.

For support, the web, i.e., the surface or side of the web facing away from the created blanket of air, may be guided on an air-permeable support element. This support element may be formed by at least one air-permeable belt that moves with the web, e.g., a press felt of the press or drainage section or a drying sieve (screen) of the drying section of a machine for producing and/or converting the web. Further, the support element may be formed as a guide roll having a perforated or grooved roll sleeve.

In either case, the surface of the web facing away from the created blanket of compressed air can be subjected to a vacuum by positioning a suction device on or adjacent to the support element. In such a combination, the air-permeable belt can also be guided around the guide roll. According to this arrangement, the belt guides the web to and from the guide roll.

The damming effect with respect to the boundary layer of air and, therefore, also to the pressure in the blanket of compressed air can be increased by reducing the distance between the web and the guide element, particularly the distance between the downstream end of the guide element and the web. Thus, the guide element may form a feeding wedge with the web that tapers down in the travel direction of the web.

The distance between the web and the guide element can be, e.g., between approximately 0.01 and 20 mm, particularly between the downstream end of the guide element and web. Depending on the basis weight, moisture, dry content, porosity, type of web and/or machine speed, the distance between the web and the guide element, in the direction in which the web travels, may be adjustable, particularly at an upstream or start end and/or the downstream end. Further, the guide element may also be positionably adjustable during operation of the machine.

Moreover, the device in accordance with the features of the present invention may automatically adjust the distance as a balance between the pressure in the blanket of compressed air and a spring resistance. In this manner, the distance may be dependent mainly on machine speed.

The guide element or elements may have a length in the direction of web travel of, e.g., between approximately 0.05 and 1.50 m, and preferably approximately 0.2 and 0.5 m. The guide elements can be formed by an at least partially fixed plate and/or a rotating continuous belt that preferably has a contoured surface for greater air drag-in. Further, the device may further enhance the drying effect if the guide element is heated.

Moreover, to increase the pressure in the blanket of compressed air, additional compressed air, particularly heated compressed air, can be blown between the guide element and the web. The additional compressed air may be preferably blown in from the start end area of the guide element with respect to the web travel direction.

For limiting or sealing the blanket of compressed air, blast nozzles, brushes, or similar devices, may be positioned on the sides of the guide element that extend in the web travel direction and are positioned opposite each other cross-wise to the web travel direction. In this manner, too sharp a decrease in the pressure of the blanket of compressed air toward the edges of the web may be prevented.

Alternatively, or in combination with the additional compressed air, a coating device for providing a coating in a dry or liquid form can be introduced into the blanket of compressed air. For example, calcium carbonate, titanium dioxide, silicate, adhesives, and starches may be particularly suitable for coating the surface of the web.

Accordingly, the present invention is directed to a process for drying a moving web. The process includes vaporizing moisture in the web, creating a blanket of compressed air along a first surface of the web, and the blanket of compressed air directing the vaporized moisture in a direction from the first surface toward a second surface of the web that faces away from said blanket of compressed air.

In accordance with another feature of the present invention, the process may include suctioning the second surface of the web.

In accordance with another feature of the present invention, the pressure in the blanket of compressed air may lie within a range between approximately 0.01 to 0.2 bar.

In accordance with still another feature of the present invention, a guide element may be positioned adjacent to the web to create said blanket of compressed air, and the process may further include adjusting a distance between at least a downstream end of the guide element relative to a web travel direction.

In accordance with a further feature of the present invention, the process may further include creating a second blanket of compressed air along the first surface of the web downstream from the blanket of compressed air relative to a web travel direction.

In accordance with a still further feature of the present invention, the process may further include supporting the second surface of the web on an air-permeable support element. The vaporized moisture may be directed toward the support element.

In accordance with still another feature of the present invention, the process further includes supporting the second surface of the web on a suction guide roll, said blanket of compressed air directing the vaporized moisture toward the suction guide roll, and suctioning the vaporized moisture directed toward the suction guide roll.

In accordance with another feature of the present invention, a guide element may be positioned adjacent to the web for creating said blanket of compressed air, and the process may further include blowing additional compressed air in a web travel direction into a region between the guide element and the web.

In accordance with still another feature of the present invention, a guide element may be positioned adjacent to the web for creating said blanket of compressed air. In this manner, a distance between the guide element and the web may be automatically set by pivotably mounting the guide element to pivot around a pivot axis extending cross-wise to the web.

In accordance with a further feature of the present invention, the process may further include delimiting a cross-wise edge of the compressed air blanket with at least one of air nozzles and brushes.

The present invention is also directed to a device for drying a moving web. The device includes an air-tight guide element positioned adjacent to the moving web and positioned to create a blanket of compressed air between the moving web and the air-tight guide element.

In accordance with another feature of the present invention, an air-permeable support element may be adapted to support the second surface of the moving web. Further, the support element may be formed by at least one air-permeable belt adapted to move along with the web. Further, a vacuum device may be arranged to suction the support element. The support element may also be formed by a guide roll having at least one of a perforated and grooved roll sleeve, and the support element may be composed of at least one air-permeable belt arranged to be wound around the guide roll and to move together with the web.

In accordance with another feature of the present invention, the guide element may be arranged to form a feed wedge with the web that tapers in a web travel direction.

In accordance with a further feature of the present invention, a distance between the web and the guide element may be between approximately 0.01 and 20 mm.

In accordance with still another feature of the present invention, a distance between a downstream end area of the guide element, relative to a web travel direction, and the web may be between approximately 0.01 and 20 mm.

In accordance with a still further feature of the present invention, the guide element may be positionally adjustable to adjust at least one of an upstream and a downstream end of the guide element, relative to a web travel direction.

In accordance with another feature of the present invention, the guide element may be mounted so that a distance between the web and the guide element is automatically adjustable against a spring resistance.

In accordance with still another feature of the present invention, the guide element may have a length in a web travel direction of between approximately 0.05 and 1.50 m. Further, the length of the guide element may be between approximately 0.2 and 0.5.

In accordance with another feature of the present invention, the guide element may be formed by a positionally adjustable fixed plate.

In accordance with a further feature of the present invention, the guide element may be formed by a rotating, continuous belt. Further, the continuous belt may have a contoured surface.

In accordance with a still further feature of the present invention, a device for heating the guide element may be provided.

In accordance with another feature of the present invention, a compressed air blower may be arranged to blow compressed air between the guide element and the web. Further, the compressed air blower may be arranged adjacent to an upstream end of the guide element relative to a web travel direction, and the compressed air blower may be adapted to blow heated compressed air.

In accordance with still another feature of the present invention, at least one of blast nozzles and brushes may be arranged to limit the blanket of compressed air cross-wise to a web travel direction.

In accordance with another feature of the present invention, at least one heated dryer cylinder may be arranged upstream of the guide element relative to a web travel direction. In this manner, moisture in the web may be vaporized.

The present invention is also directed to a process for drying a web composed of one of paper or tissue. The process includes guiding the web through at least one of a press section and a dryer section of a machine for producing the web, vaporizing moisture in the web, creating a blanket of compressed air along a first surface of the web, and the blanket of compressed air directing the vaporized moisture in a direction from the first surface of the web toward a second surface of the web that faces away from said blanket of compressed air.

In accordance with yet another feature of the present invention, the process further includes supporting the web on an air-permeable belt composed of one of a press felt and a drying sieve.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
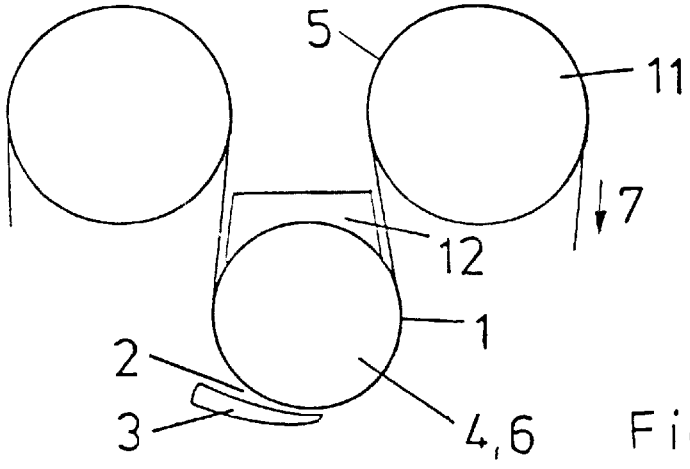
FIG. 1 illustrates a guide element 3 adjacent to a vacuum guiding roller 6 of a drying section.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As shown in FIGS. 1–4, a web 1 may be guided over dryer cylinders 11, which vaporizes moisture in web 1 to form steam. On one side of web 1, a blanket of compressed air 2 is created to press or direct the steam of the web 1 in a direction from the blanket of compressed air 2 toward a side or surface of web 1 that faces away from blanket of compressed air 2, i.e., toward a support element 4. In this simple manner, the carry-off of steam is improved and the drying result of web I is also significantly improved.

The pressure in the blanket of compressed air 2 may be, e.g., in a range between approximately 0.01 and 0.2 bar, and may be created via the damming or accumulation of a boundary layer of air carried along or entrained by movement of web 1 by a guide element 3, e.g., an air-tight guide element, positioned adjacent to web 1. Air tight guide element 3 may be formed, e.g., of fiber glass with epoxy resin or of steel.

The surface of web 1 facing away from the blanket of compressed air 2 may be supported on an air-permeable support element 4. Support element 4 may be formed, e.g., by a vacuum guide roll 6 having a perforated roll sleeve. A negative pressure may be formed within guide roll 6 via a suction box 12 arranged over a periphery of guide roll 6 that is not covered by supported web 1. Alternatively, the negative pressure within guide roll 6 may be formed via an internal suction device.

Between guide roll 6 and web 1, an air-permeable belt 5, e.g., a drying sieve or screen, may be arranged to transport web 1. Belt 5 may guide web 1 between guide rolls 6 and heated drying cylinders 11 and press web 1 against the heated surfaces of drying cylinders 11.

Instead of the drying sieve, air-permeable belt 5 may be formed, e.g., with a press felt wound around guide roll 6.

Although guide elements 3 may be positioned in the vicinity of guide roll 6, it is also possible to position guide elements 3 in an area between guide roll 6 and drying cylinder 11. In this case, belt 5 is utilized as support element 4.

Guide element 3 can be arranged to form a feed wedge that tapers toward web 1 in a direction of web travel 7 so that the pressure in the blanket of compressed air 2 increases in web travel direction 7. A distance between web 1 and guide element 3, at least at a downstream end area, relative to web travel direction 7, may be, e.g,. within a range between approximately 0.01 to 20 mm. Guide elements 3 may have a length in web travel direction 3 of, e.g., approximately 0.05 to 1.5 m, and preferably approximately 0.2 to 0.5 m.

Guide element 3 may be formed, e.g., by an at least partially fixed plate, which can be composed of a rigid or a flexible material. Further, guide element 3 may be heatable, and/or provided with heatable elements that are, e.g. electrically or steam heatable.

Figure 2:
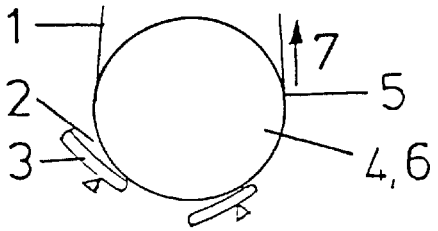
FIG. 2 illustrates an arrangement of two guide elements adjacent to a guide roll.

While guide element 3 depicted in FIG. 1 may be rigidly positioned in operation, and it may be adjustable, if desired, to set a predetermined angle and distance to web 1. Guide elements 3, as shown in FIG. 2, may be pivotably mounted to tilt along a tilting axis that extends parallel to the axis of guide roll 6. As a result, guide element 3 may be automatically positionably adjustable during operation. In this regard, the tilting axis may be located such that a ratio of the length of the guide element upstream of the tilting axis to the length of the guide element downstream of the tilting axis is, e.g., approximately 3:2.

Figure 3:
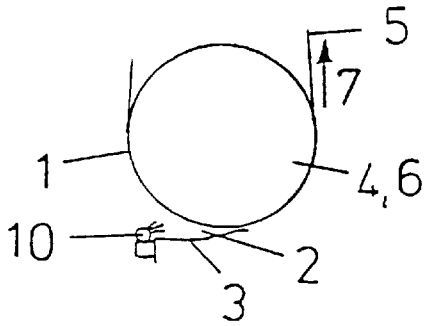
FIG. 3 illustrates an arrangement utilizing a flexible guide element.

In FIG. 3, guide element 3 may be made of, e.g., a resilient material. As with the other arrangements, the orientation and/or deformation of guide element 3 may automatically adjust during operation.

Further, compressed air, and preferably heated compressed air, may be blown via blast nozzles 10 arranged at an upstream end of guide element 3 between guide element 3 and web 1. In this manner, an increase in the pressure of the blanket of compressed air 2 may be provided. Moreover, in this manner, specific materials, e.g., resin, ceramic particles, and mixtures thereof, and coating materials, can be introduced into blanket of compressed air 2 to be applied to web 1. Such coating materials may be, e.g., calcium carbonate, titanium dioxide, silicate, adhesives, and starches.

Figure 4:
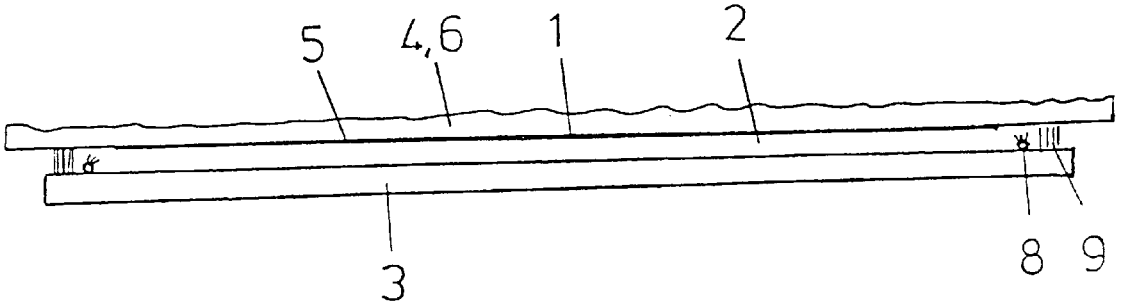
FIG. 4 illustrates a cross-section through the blanket of compressed air.

As shown in FIG. 4, blanket of compressed air 2 may be limited by positioning a blast nozzle 8 and a brush 9 at the sides of guide element 3, which are located opposite each other cross-wise to the web travel direction 7.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for drying a moving web including a first surface and a second surface, the process comprising:

vaporizing moisture in the web;

creating a blanket of compressed air along the first surface of the web; and moving the second surface of the web on a roll having a perforated surface, wherein the blanket of compressed air directs the vaporized moisture in a direction from the first surface toward the second surface of the web.

2. The process if claim 1, further comprising suctioning the second surface of the web.

3. The process of claim 1, wherein the pressure in the blanket of compressed air lies within a range between approximately 0.01 to 0.2 bar.

4. The process of claim 1, wherein a guide element is positioned adjacent to the web to create the blanket of compressed air, and the process further comprises adjusting a distance between at least a downstream end of the guide element relative to a web travel direction.

5. The process of claim 1, wherein the blanket of compressed air comprises a first blanket of compressed air and wherein the process further comprises creating a second blanket of compressed air along the first surface of the web downstream from the first blanket of compressed air relative to a web travel direction.

6. The process of claim 1, wherein the roll comprises an air-permeable support element.

7. The process of claim 1, further comprising:

supporting the second surface of the web on the roll, wherein the roll comprises a suction guide roll;

and suctioning the vaporized moisture using the suction guide roll.

8. The process of claim 1, wherein a guide element is positioned adjacent to the web for creating the blanket of compressed air, and the process further comprises:

blowing additional compressed air in a web travel direction into a region between the guide element and the web.

9. The process of claim 1, wherein a guide element is positioned adjacent to the web for creating the blanket of compressed air, whereby a distance between the guide element and the web is automatically set by pivotally mounting the guide element to pivot around a pivot axis extending cross-wise to the web.

10. The process of claim 1, further comprising:

delimiting a cross-wise edge of the blanket of compressed air with at least one of air nozzles and brushes.

11. The process of claim 1, further comprising supporting the web on an air-permeable belt composed of one of a press felt and a drying sieve.

12. A process for drying a web wherein the web includes one of paper and tissue, a first surface and a second surface, the process comprising:

guiding the web through at least one of a press section and a dryer section of a machine for producing the web;

vaporizing moisture in the web;

creating a blanket of compressed air along the first surface of the web; and moving the second surface of the web on a roll having a perforated surface, wherein the blanket of compressed air directs the vaporized moisture in a direction from the first surface toward the second surface of the web.

13. The process of claim 12, further comprising supporting the web on an air-permeable belt composed of one of a press felt and a drying sieve.

14. A process for drying a moving web comprising:

vaporizing moisture in the web; and creating a blanket of compressed air along a first surface of the web;

wherein the blanket of compressed air directs the vaporized moisture in a direction from the first surface toward a second surface of the web that faces away from the blanket of compressed air, and wherein the blanket of compressed air comprises a pressure which lies within a range between approximately 0.01 to 0.2 bar.

15. A process for drying a moving web comprising:

vaporizing moisture in the web; and creating a blanket of compressed air along a first surface of the web;

wherein the blanket of compressed air directs the vaporized moisture in a direction from the first surface toward a second surface of the web that faces away from the blanket of compressed air, and wherein a guide element is positioned adjacent to the web to create the blanket of compressed air, and the process further comprises adjusting a distance between at least a downstream end of the guide element relative to a web travel direction.

16. A process for drying a moving web comprising:

vaporizing moisture in the web;

creating a first blanket of compressed air along a first surface of the web;

wherein the blanket of compressed air directs the vaporized moisture in a direction from the first surface toward a second surface of the web that faces away from the blanket of compressed air; and creating a second blanket of compressed air along the first surface of the web and downstream from the first blanket of compressed air relative to a web travel direction.

17. A process for drying a moving web comprising:

vaporizing moisture in the web; and creating a blanket of compressed air along a first surface of the web;

wherein the blanket of compressed air directs the vaporized moisture in a direction from the first surface toward a second surface of the web that faces away from the blanket of compressed air;

supporting the second surface of the web on a suction guide roll;

the blanket of compressed air directing the vaporized moisture toward the suction guide roll; and suctioning the vaporized moisture directed toward the suction guide roll.

18. A process for drying a moving web comprising:

vaporizing moisture in the web; and creating a blanket of compressed air along a first surface of the web;

wherein the blanket of compressed air directs the vaporized moisture in a direction from the first surface toward a second surface of the web that faces away from the blanket of compressed air, and wherein a guide element is positioned adjacent to the web for creating the blanket of compressed air, and the process further comprises blowing additional compressed air in a web travel direction into a region between the guide element and the web.

19. A process for drying a moving web comprising:

vaporizing moisture in the web; and creating a blanket of compressed air along a first surface of the web;

wherein the blanket of compressed air directs the vaporized moisture in a direction from the first surface toward a second surface of the web that faces away from the blanket of compressed air, and wherein a guide element is positioned adjacent to the web for creating the blanket of compressed air, whereby a distance between the guide element and the web is automatically set by pivotally mounting the guide element to pivot around a pivot axis extending cross-wise to the web.

20. A process for drying a moving web comprising:

vaporizing moisture in the web;

creating a blanket of compressed air along a first surface of the web;

wherein the blanket of compressed air directs the vaporized moisture in a direction from the first surface toward a second surface of the web that faces away from the blanket of compressed air; and delimiting a cross-wise edge of the blanket of compressed air with at least one of air nozzles and brushes.

* * * * *